US007681979B2

(12) United States Patent
Huang et al.

(10) Patent No.: US 7,681,979 B2
(45) Date of Patent: Mar. 23, 2010

(54) INKJET PRINTING SYSTEM AND METHOD CAPABLE OF AUTOMATICALLY CALIBRATING A NON-UNIFORM SPEED OF A PRINTHEAD CARRIAGE

(76) Inventors: Yu-Chu Huang, 3F, No.21, Sec. 3, Chongcing S. Rd., Jhongjheng District, Taipei City (TW) 100; Chun-Chi Chen, 3F., No.30, Alley 53, Lane 66, Dongyuan St., Wanhua District, Taipei City (TW) 108

( * ) Notice: Subject to any disclaimer, the term of this patent is extended or adjusted under 35 U.S.C. 154(b) by 466 days.

(21) Appl. No.: 11/826,856

(22) Filed: Jul. 19, 2007

(65) Prior Publication Data

US 2008/0018693 A1 Jan. 24, 2008

(30) Foreign Application Priority Data

Jul. 19, 2006 (TW) ..... 95126340 A

(51) Int. Cl.
*B41J 29/393* (2006.01)

(52) U.S. Cl. ..... 347/19; 347/37

(58) Field of Classification Search ..... 347/19, 347/37

See application file for complete search history.

(56) References Cited

U.S. PATENT DOCUMENTS

| | | | | |
|---|---|---|---|---|
| 5,448,269 | A | 9/1995 | Beauchamp et al. | 347/19 |
| 5,997,130 | A | 12/1999 | Bolash et al. | 347/37 |
| 6,361,137 | B1 | 3/2002 | Eaton et al. | 347/14 |
| 6,585,340 | B1 * | 7/2003 | Borrell | 347/14 |
| 7,588,302 | B2 * | 9/2009 | Bastani et al. | 347/8 |

* cited by examiner

*Primary Examiner*—Lamson D Nguyen
(74) *Attorney, Agent, or Firm*—Bacon & Thomas, PLLC

(57) ABSTRACT

An inkjet printing system and method capable of automatically calibrating non-uniform speed of a printhead carriage, which includes a test pattern generator, a printing device, an image extractor, a processor and a printhead carriage control signal generator. The test pattern generator generates at least one test pattern. The printing device prints the test pattern on a recording medium. The image extractor captures an image of the test pattern. The processor reads and analyzes the image of the test pattern to accordingly generate a look-up table. The printhead carriage control signal generator generates an inkjet control signal for the printhead carriage, and adjusts a clock of the inkjet control signal in accordance with the look-up table.

20 Claims, 6 Drawing Sheets

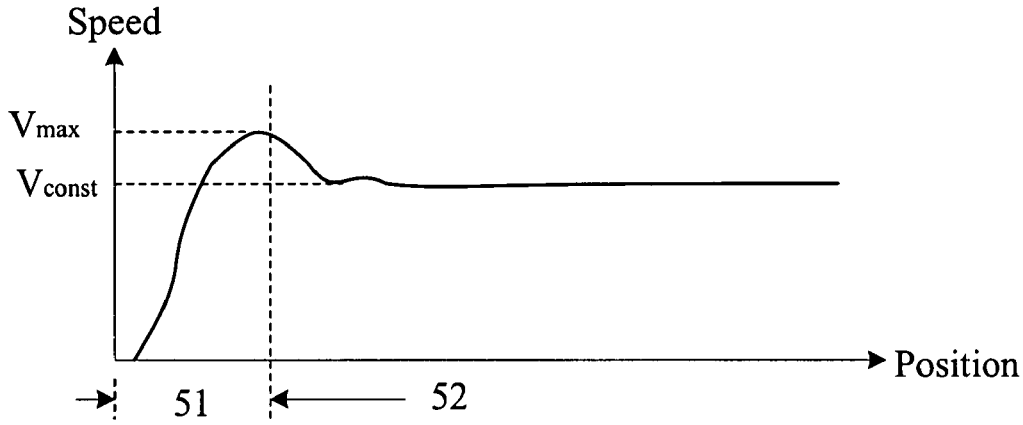
FIG. 5A
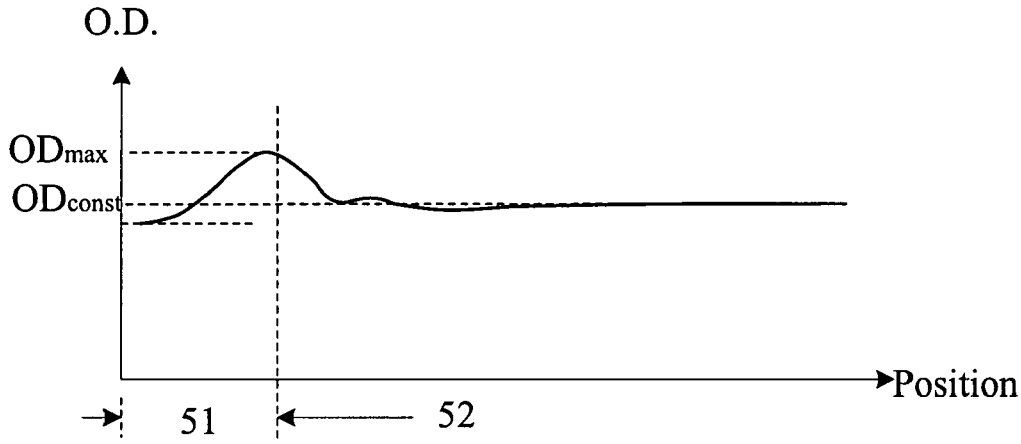
FIG. 5B
| Position | 0 | 1 | 2 | ... | 4799 |
|---|---|---|---|---|---|
| O.D. | 1.2 | 1.4 | 1.5 | ... | 1.8 |
FIG. 5C
| Position | 0 | 1 | 2 | ... | 4799 |
|---|---|---|---|---|---|
| Delay | 200 | 196 | 193 | ... | 186 |
FIG. 5D

INKJET PRINTING SYSTEM AND METHOD CAPABLE OF AUTOMATICALLY CALIBRATING A NON-UNIFORM SPEED OF A PRINTHEAD CARRIAGE

BACKGROUND OF THE INVENTION

1. Field of the Invention

The invention relates to the technical field of inkjet printing and, more particularly, to an inkjet printing system and method capable of automatically calibrating non-uniform speed of a printhead carriage.

2. Description of Related Art

For current inkjet printing technology, the print quality and the throughput generally conflict and require a compromise. For example, a multi-pass printing is required for a photo-level print quality. In this case, the printhead reciprocates in a carriage scan direction many times to thereby gradually produce a complete image output.

An example is given by a desktop photo printer with model number 6578 of Hewlett-Packard cooperation. For an A4 photo printout by the HP 6578, the printhead requires the reciprocation for printing by 400 swatches. For each swatch, the printhead carriage is carried with the course of start, acceleration, uniform motion and retardation by the driver motor. Therefore, the printout speed is a bottleneck of the current inkjet printing technology.

In addition, for a typical inkjet printing, the ink ejection is carried out when the printhead enters in a uniform zone. As a consideration of the ejection speed of ink droplets in a horizontal direction, the printed image is distorted to result in printing defects or errors, and a poor print quality in case that the ink is ejected in accordance with a fixed clock and the printhead carriage starts to print as soon as the printhead carriage enters in an acceleration/retardation zone.

U.S. Pat. No. 5,997,130 granted to Bolash et. al. for an "asymmetrical acceleration ramp area and method for print cartridge carrier of ink jet printer" has disclosed an asymmetrical acceleration zone, which can reduce the working space without affecting the print quality. FIG. 1 is a graph schematically illustrating the speeds of a print cartridge carrier in the U.S. Pat. No. 5,997,130. As shown in FIG. 1, the speeds are not calibrated substantially since it only reduces the reserved space for the acceleration or retardation zone, wherein the reserved space for the retardation zone is reduced in this case. Accordingly, when a high quality output mode is selected in printing, it prints in a single direction, starts the printhead to print a swatch from one side that reserves the space for the acceleration zone, and keeps a uniform speed in this zone. As soon as the print zone is passed, a relative retardation is proceeded to stop the printhead. Because the bi-directional printing is not required, the problems associated with the acceleration and retardation zones are not considered in the backward travel of the printhead. However, for printing in a script mode, the required amount of ink droplets is considerably reduced, and the quality requirement is also reduced. In this case, the printing in bi-direction can be started before the printhead carriage reaches to the uniform zone, which affects the print quality but still meets with the requirement of the script mode.

U.S. Pat. No. 6,361,137 granted to Eaton et. al. for a "method and apparatus for compensating for variations in printhead-to-media spacing and printhead scanning velocity in an ink-jet hard copy apparatus" has disclosed a method of calibrating the speed on a printhead carriage, which uses a complicated hardware circuit to determine a carriage speed and a printing clock. The printing clock is a function of the motion speed on the carriage and the distance from the printhead to a paper. U.S. Pat. No. 6,361,137 does not print a test pattern so as not to read and analyze the result of a test pattern printing, and instead uses a droplet-flight-time measurement module to real-time analyze the instant speed in accordance with a received encoder signal with respect to the printhead travel, and to determine a measured flight time of ink droplets in a certain range for further determining a clock on the inkjet control signal. In addition, a system clock signal is interpolated between two encoder signals to thereby measure the speed presented on a time axis and the flight time of ink droplets. Thus, the inkjet clock is determined. However, this requires a complicated hardware to determine the carriage speed and the printing clock.

U.S. Pat. No. 5,448,269 granted to Beauchamp et. al. for a "multiple inkjet cartridge alignment for bidirectional printing by scanning a reference pattern" has disclosed a method of calibrating a placement error caused by the initial exit speed of ink droplets. U.S. Pat. No. 5,448,269 calibrates the placement error caused by a curve of the paper roller in a paper advance direction. Namely, the speed is calibrated at a bi-directional print mode. In U.S. Pat. No. 5,448,269, the method first prints a test pattern formed with vertical lines, then uses an optical sensor to read the test pattern, and finally analyzes the error to accordingly calibrate the ejection speed by adding additional delays to the inkjet clock for partial holes or orifices. The method essentially compensates for the error caused by the curve of the paper roller, not for the error caused by the non-uniform carriage speed. Hence, an improvement to the typical inkjet printing system is desired.

SUMMARY OF THE INVENTION

An object of the invention is to provide an inkjet printing system and method capable of automatically calibrating non-uniform speed of a printhead carriage, which can automatically calibrate the errors caused by the non-uniform carriage speed to thereby enhance the print quality.

Another object of the invention is to provide an inkjet printing system and method capable of automatically calibrating non-uniform speed of a printhead carriage, which can reduce the space of the acceleration and retardation zones in a print zone.

A further object of the invention is to provide an inkjet printing system and method capable of automatically calibrating non-uniform speed of a printhead carriage, which can generate a look-up table in off-line to thereby avoid the problem of requiring a complicated hardware circuit in the prior art.

In accordance with one aspect of the invention, there is provided an inkjet printing system capable of automatically calibrating non-uniform speed of a printhead carriage. The system includes a test pattern generator, a printing device, an image extractor, a processor and a printhead carriage control signal generator. The test pattern generator generates at least one test pattern. The printing device is connected to the test pattern generator in order to print the at least one test pattern on a recording medium. The image extractor captures an image of the test pattern from the recording medium. The processor is connected to the image extractor in order to read and analyze the image of the test pattern to accordingly generate a look-up table. The printhead carriage control signal generator generates an inkjet control signal for the printhead carriage, and adjusts a clock of the inkjet control signal in accordance with the look-up table to thereby generate an adjusted inkjet control signal for the printhead carriage to perform an automatic calibration.

In accordance with another aspect of the present invention, there is provided an inkjet printing method capable of automatically calibrating non-uniform speed of a printhead carriage. The method includes the steps of: (A) receiving an automatic calibration request; (B) printing at least one test pattern on a recording medium at a special print mode in accordance with the automatic calibration request; (C) capturing an image of the test pattern from the recording medium, and analyzing the image to accordingly generate a look-up table; (D) adjusting a clock of an inkjet control signal for the printhead carriage in accordance with the look-up table to thereby output an adjusted inkjet control signal to the printhead carriage for performing an automatic calibration.

In accordance with a further aspect of the present invention, there is provided an inkjet printing system capable of automatically calibrating non-uniform speed of a printhead carriage. The system includes a test pattern generator, a printing device, an image extractor, a processor, a printhead carriage control signal generator and a look-up table device. The test pattern generator generates at least one test pattern. The printing device is connected to the test pattern generator in order to print the at least one test pattern on a recording medium. The image extractor captures an image of the test pattern from the recording medium. The processor is connected to the image extractor in order to read and analyze the image of the test pattern to accordingly generate a look-up table. The printhead carriage control signal generator receives an encoder signal with respect to a printhead travel, and generates an inkjet control signal for the printhead carriage in accordance with the encoder signal. The look-up table device is connected to the processor and the printhead carriage control signal generator in order to receives the look-up table generated by the processor and accordingly adjusts a clock of the inkjet control signal to thereby generate an adjusted encoder signal.

Other objects, advantages, and novel features of the invention will become more apparent from the following detailed description when taken in conjunction with the accompanying drawings.

BRIEF DESCRIPTION OF THE DRAWINGS

FIG. 5A is a graph schematically illustrating of a speed change of an inkjet printhead in accordance with the invention;

FIG. 5B is a graph schematically illustrating of an optical density change of the image of a test pattern in accordance with the invention;

FIG. 5C is a schematic diagram of an optical density table of the image of a test pattern in accordance with the invention;

FIG. 5D is a schematic diagram of a look-up table in accordance with the invention.

DETAILED DESCRIPTION OF THE PREFERRED EMBODIMENT

The invention uses an image extraction sensor to read and analyze a printed test pattern and generate a look-up table. Accordingly, when the printhead carriage locates in an acceleration or retardation zone, the printhead in printing can automatically calibrate the placement error of an ink droplet caused by different speeds. In addition, the non-uniform carriage speed caused by various factors is also calibrated.

Figure 1:
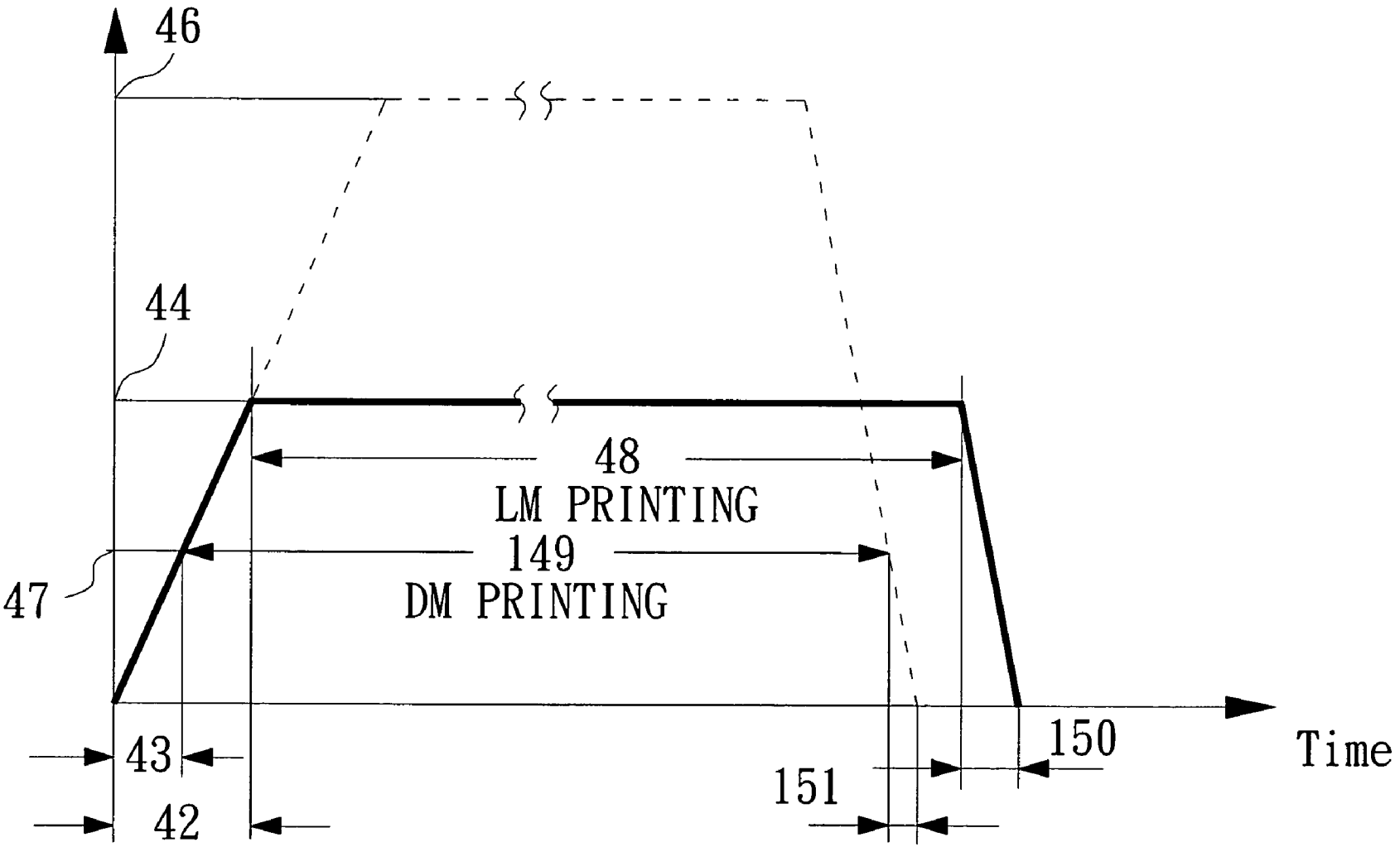
FIG. 1 (Prior Art)
FIG. 1 is a graph schematically illustrating the speeds of a print cartridge carrier.
Figure 2:
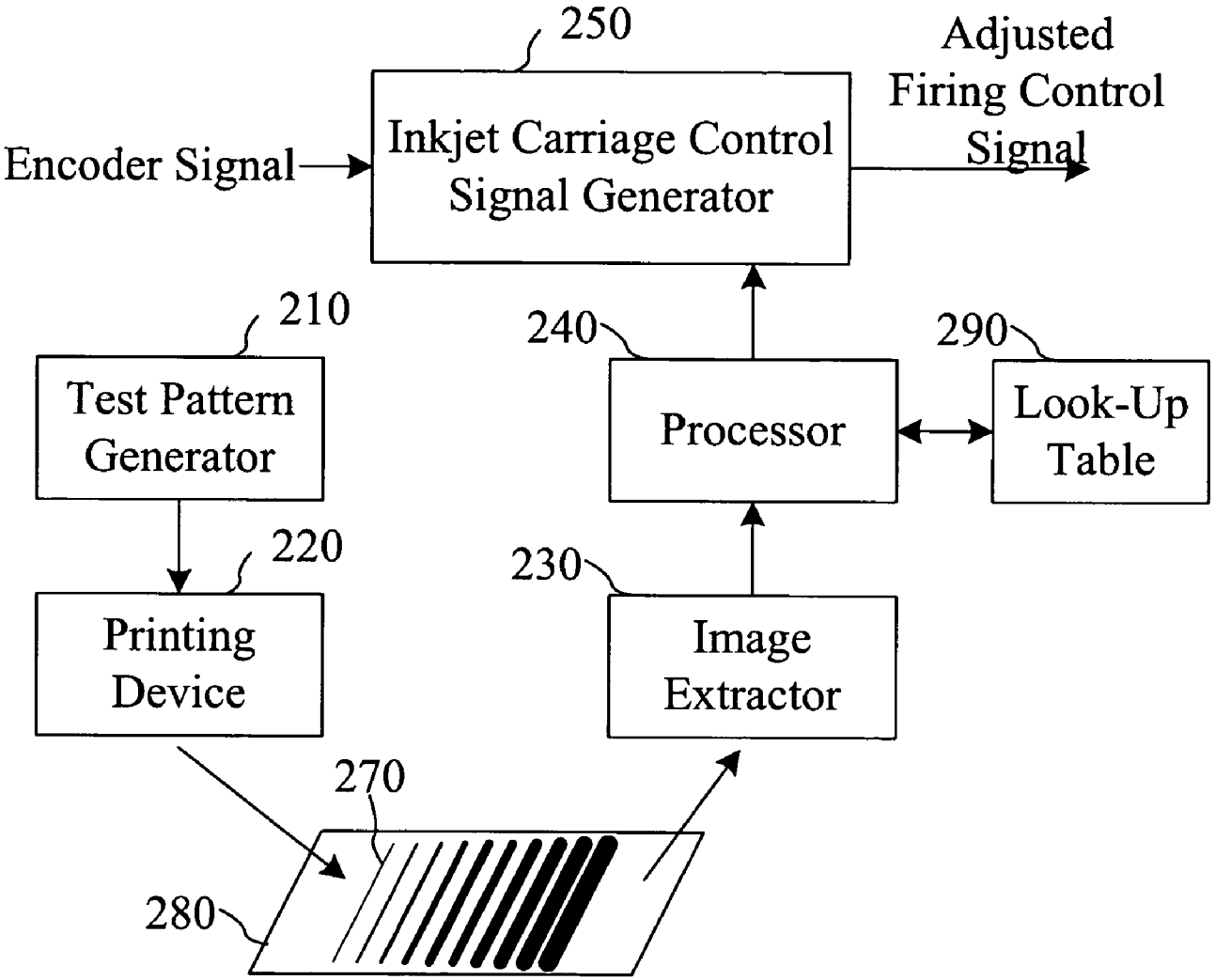
FIG. 2 is a block diagram of an inkjet printing system capable of automatically calibrating non-uniform speed of a printhead carriage in accordance with an embodiment of the invention.

FIG. 2 is a block diagram of an inkjet printing system capable of automatically calibrating non-uniform speed of a printhead carriage in accordance with an embodiment of the invention, which is used in an inkjet printing-type multifunction peripheral. As shown in FIG. 2, the inkjet printing system includes a test pattern generator 210, a printing device 220, an image extractor 230, a processor 240 and a printhead carriage control signal generator 250.

As shown in FIG. 2, the test pattern generator 210 generates at least one test pattern 270. The test pattern 270 is formed with vertical lines or color blocks.

The printing device 220 is connected to the test pattern generator 210 in order to print the test pattern 270 on a recording medium 280. The recording medium is an opaque or transparent recording medium. The opaque recording medium is preferably a paper or photo paper. The transparent recording medium is preferably a transparency.

The image extractor 230 captures the image of the test pattern 270 from the recording medium 280. The image extractor 230 is an optical sensor. The optical sensor is preferably a charge coupled device (CCD)-type sensor or a contact image sensor (CIS)-type sensor.

The processor 240 is connected to the image extractor 230 in order to read and analyze the image of the test pattern 270 to accordingly generate a look-up table 290. If the test pattern 270 is formed with the vertical lines, the processor 240 analyzes the alignment level and shift error of the vertical lines and accordingly generates the look-up table 290. If the test pattern 270 is formed with color blocks, the processor 240 analyzes the hug shift of the color blocks and accordingly generates the look-up table 290.

The printhead carriage control signal generator 250 generates an encoder signal with respect to the printhead travel, and accordingly generates an inkjet control signal for the printhead carriage.

The printhead carriage control signal generator 250 adjusts a clock of the inkjet control signal for the printhead carriage, and accordingly generates an adjusted encoder signal with respect to the printhead travel. Thus, the speed change or non-uniformity of the printhead carriage is calibrated by adjusting the clock of the inkjet control signal for the printhead carriage.

Figure 3:
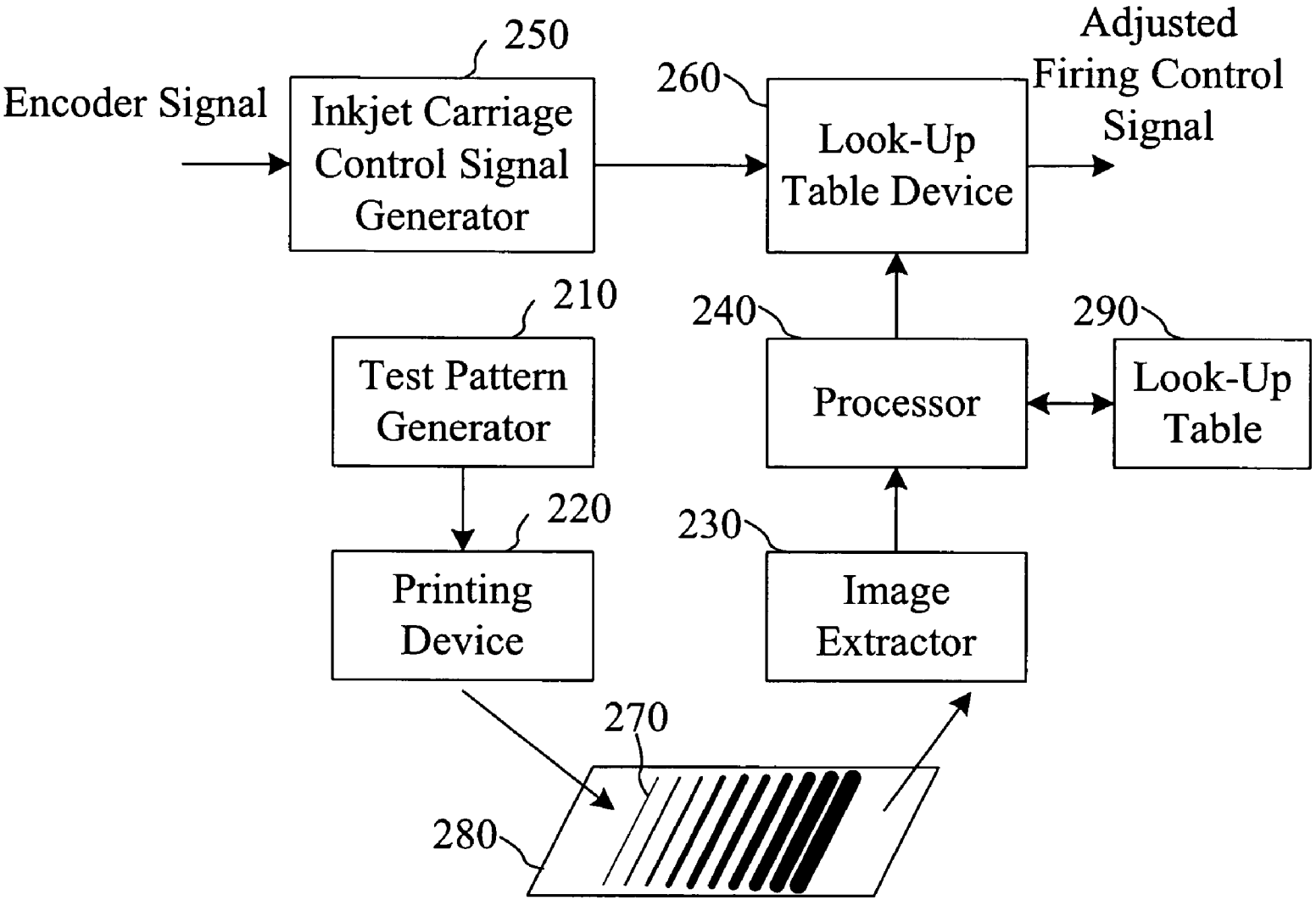
FIG. 3 is a block diagram of an inkjet printing system capable of automatically calibrating non-uniform speed of a printhead carriage in accordance with another embodiment of the invention.

FIG. 3 is a block diagram of an inkjet printing system capable of automatically calibrating non-uniform speed of a printhead carriage in accordance with another embodiment of the invention. As shown in FIG. 3, this embodiment adds a look-up table device 260 in addition to all devices of FIG. 2. The look-up table device 260 can simplify the tasks of the printhead carriage control signal generator 250. In this embodiment, the printhead carriage control signal generator 250 receives an encoder signal with respect to a printhead travel, and accordingly generates an inkjet control signal for the printhead carriage.

The look-up table device 260 is connected to the processor 240 and the printhead carriage control signal generator 250. The look-up table device 260 receives the look-up table 290 generated by the processor 240, and accordingly adjusts the clock of the inkjet control signal to thereby generate an adjusted encoder signal.

Figure 4:
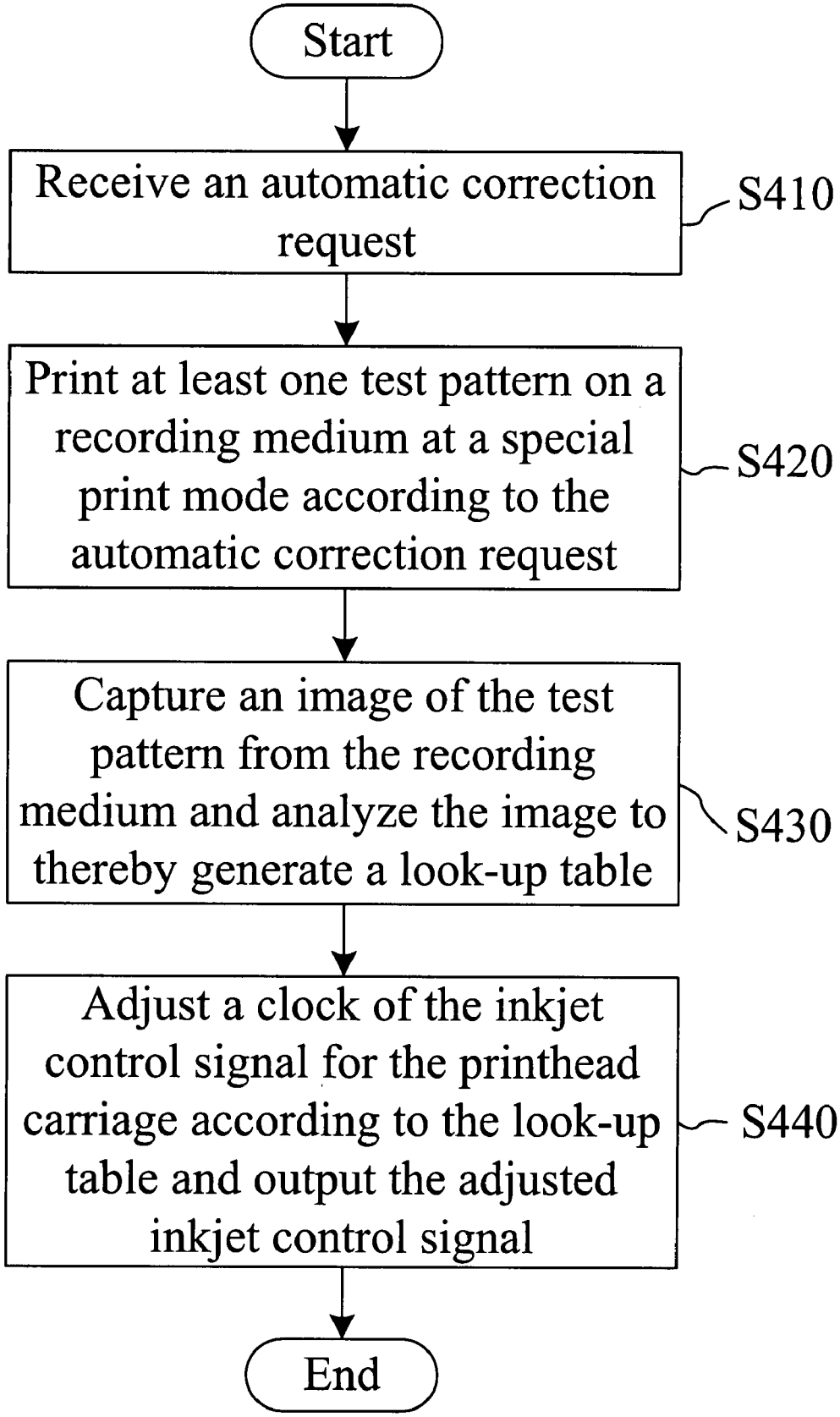
FIG. 4 is a flowchart of an inkjet printing method capable of automatically calibrating non-uniform speed of a printhead carriage in accordance with an embodiment of the invention.

FIG. 4 is a flowchart of an inkjet printing method capable of automatically calibrating non-uniform speed of a printhead carriage in accordance with an embodiment of the invention, which is used in an inkjet printing-type multifunction peripheral. As shown in FIG. 4, step S410 receives an automatic calibration request. The machine is provided with an automatic calibration button such that the automatic calibration request is generated by pressing the button from a user. Alternatively, the automatic calibration request can be generated automatically by the machine. For example, the machine automatically generates the automatic calibration request when power-on.

Step S420 prints at least one test pattern 270 on a recording medium 280 at a special print mode in accordance with the automatic calibration request. The test pattern 270 is formed with vertical lines or color blocks. The recording medium is an opaque or transparent recording medium. The opaque recording medium is preferably a paper or photo paper. The transparent recording medium is preferably a transparency.

Step S430 captures the image of the test pattern 270 from the recording medium 280, and analyzes the image to accordingly generate a look-up table 290. If the test pattern 270 is formed with the vertical lines, the processor 240 analyzes the alignment level and shift error of the vertical lines and accordingly generates the look-up table 290. If the test pattern 270 is formed with color blocks, the processor 240 analyzes the hug shift of the color blocks and accordingly generates the look-up table 290.

At the special print mode, the special print mode contains the factors of print resolution, printhead speed curve, print speed of the terminal and the like. The printing result can respond the speed change or non-uniformity of the printhead carriage. For example, in the acceleration and retardation zones, the unequal pitch between the printed lines is presented and cannot be aligned, or the printed color blocks are non-uniform so as to have hue shift. The printed image distributed over the entire width size of the print page can be read by the image extractor 230 and analyzed by the processor 240. The processor 240 analyzes an extracted image in accordance with the optical density (O.D.) of the extracted image. The analysis includes the items of unaligned and unequal pitches or non-uniform blocks. Thus, the processor 240 can use the optical density analysis to generate a look-up table 290 that is a function of spatial position. For a practical printing, a clock of the inkjet control signal is adjusted in accordance with the printhead position, which can advance or delay the output of the inkjet control signal.

FIG. 5A is a graph schematically illustrating the printhead speeds in accordance with the invention, where the horizontal axis indicates the printhead position and the vertical axis indicates the printhead speed. As shown in FIG. 5A, in the acceleration zone 51, the printhead speed is gradually increased to a maximum speed $V_{max}$ from zero. In the uniform zone 52, the printhead speed maintains at $V_{const}$.

The image extractor 230 captures the image of the test pattern 270 from the recording medium 280. The processor 240 generates an optical density table based on the image features of the test pattern 270. FIG. 5B is a graph schematically illustrating the optical density change of the image of the test pattern 270 in accordance with the invention. As shown in FIG. 5B, in the acceleration zone 51, the optical density increasingly reaches to a maximum value $OD_{max}$, and in the uniform zone 52, the optical density gradually reaches to a fixed value $OD_{const}$.

FIG. 5C is a schematic diagram of the optical density table of the image of the test pattern in accordance with the invention. As shown in FIG. 5C, if the recording medium has a width of eight inches, for 600 dots per inch (600 dpi), a line printed by the recording medium 280 contains 4800 print dots. Namely, the optical density table has 4800 position fields numbered from zero to 4799 to thereby record the optical density of each dot position.

The processor 240 generates a look-up table 290 in accordance with the optical density table. FIG. 5D is a schematic diagram of the look-up table in accordance with the invention. The look-up table 290 generates a delay based on each printhead position. Namely, the delays in the look-up table 290 are a function of position, i.e., delay=func(position). As shown in FIG. 5D, the delays respectively for the printhead carriage at each position are recorded. For example, when the printhead carriage locates at position 2, the delay is 193 units of time. In this embodiment, a unit of time is one microsecond (μs).

Figure 6:
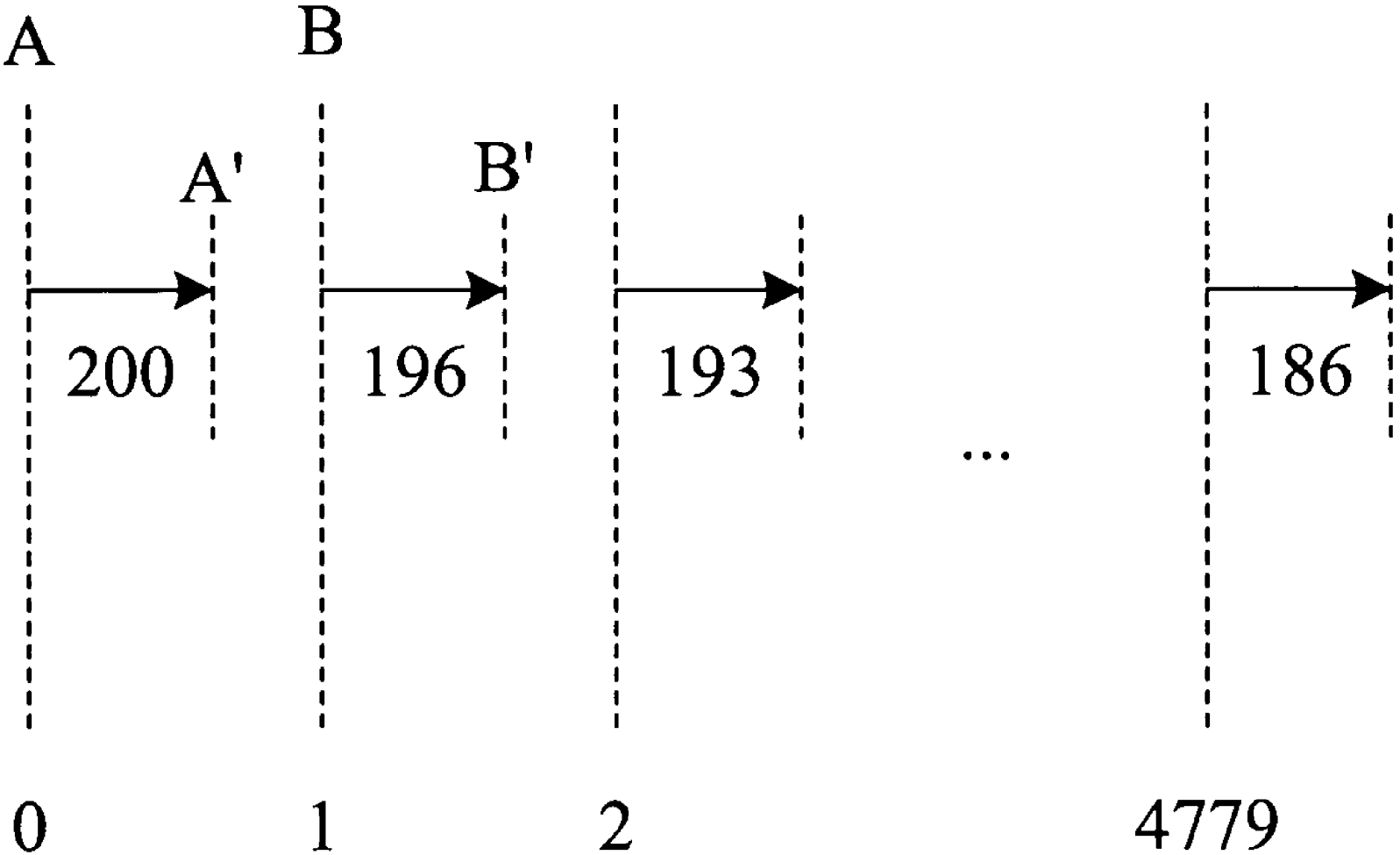
FIG. 6 is a schematic diagram of a clock of an adjusted inkjet control signal in accordance with the invention.

Step S440 adjusts the clock of the inkjet control signal of the printhead carriage in accordance with the look-up table 290, and outputs the adjusted inkjet control signal. FIG. 6 is a schematic diagram of the clock of the adjusted inkjet control signal in accordance with the invention. As shown in FIG. 6, when the printhead locates at position 0, the inkjet control signal for the printhead carriage is output originally at time A, but in accordance with the look-up table, the output is changed to time A'. Namely, the output of the inkjet control signal is delayed 200 μs. Therefore, adjusting the clock of the inkjet control signal for the printhead carriage can benefit the ink droplets to more uniformly distributed over the acceleration and retardation zones to thereby reduce the spaces required for the acceleration and retardation zones.

In view of foregoing, it is known that the invention uses the adaptively pre-determined look-up table to calibrate the inkjet control signal for printing in the acceleration and retardation zones. The look-up table can be generated offline, which is complete by printing the test pattern and analyzing the data read by the image extractor. Accordingly, the invention does not need a lot of real-time computation or complicated hardware circuit so as to have a simple and low cost structure.

In addition, the optical sensor typically mounted on the printhead carriage can scan the optical density of a print pattern for an analysis by the processor 240, without adding a new component. A multifunction peripheral (MFP) equipped with a CCD-type sensor or a CIS-type sensor can use a higher horizontal scan resolution to thereby obtain the captured image data more complete. Thus, a more accurate look-up table for calibration is generated.

Thus, when a swath is printed by the ink ejection technique of the invention, the acceleration and retardation zones can be utilized to thus reduce the reciprocation distance required by the printhead and increase the printout speed. Further, the workspace for reserving the additional space for the acceleration and retardation can be reduced in a printer design. Accordingly, the used space of a printing mechanism is more efficient to further effectively reduce the cost.

The invention analyzes the test pattern to thereby generate a look-up table to calibrate the positions of the printhead carriage and determine the clock of the inkjet control signal, without requiring complex computation and real-time capability to compute the complex data as in the prior art. The look-up table generated offline in the invention corresponds to the clock of required ink ejection, which is simple and cheap.

Because in the invention the function of automatically calibrating the carriage speed non-uniformity can be built in the user interface. The user can perform a self-detection and calibration based on the demands or the system suggestion. The calibration procedure is simple, which requires only printing a test pattern and starting the image extractor to obtain the data. The following analysis and look-up table establishment is automatically completed by the system. The established look-up table can be further used in printing. Namely, the inkjet printing system capable of automatically calibrating non-uniform speed of a printhead carriage can real-time respond the condition of entire printing mechanism and provide proper calibration. Thus, the factors of mechanical abrasion and aging, transporter (such as a belt) changes, printhead weight changes caused by printing can be effectively calibrated, and accordingly the best print quality and the optimized printout speed are obtained.

Thus, in addition to calibrating the placement errors of ink droplets caused in the acceleration and retardation zones, the invention can also calibrate the motion speed non-uniformity caused by the control or mechanical factor to thereby obtain the best output.

The inkjet printing system capable of automatically calibrating non-uniform speed of a printhead carriage can calibrate the placement errors of ink droplets caused in the acceleration and retardation zones and the motion speed non-uniformity caused by the control or mechanical factor to thereby obtain the best print quality and the optimized printout speed. In addition, the invention can generate the look-up table in off-line, without requiring a lot of real-time computation or a complicated hardware circuit shown in the prior art. Accordingly, the invention has the features of being simple and cheap.

Although the present invention has been explained in relation to its preferred embodiment, it is to be understood that many other possible modifications and variations can be made without departing from the spirit and scope of the invention as hereinafter claimed.

What is claimed is:

1. An inkjet printing system capable of automatically calibrating non-uniform speed of a printhead carriage, including:

a test pattern generator, which generates at least one test pattern;

a printing device, which is connected to the test pattern generator in order to print the at least one test pattern on a recording medium;

an image extractor, which captures an image of the test pattern from the recording medium;

a processor, which is connected to the image extractor in order to read and analyze the image of the test pattern to accordingly generate a look-up table; and a printhead carriage control signal generator, which receives an encoder signal with respect to a printhead travel and generates an inkjet control signal for the printhead carriage in accordance with the encoder signal;

wherein the printhead carriage control signal generator adjusts a clock of the inkjet control signal in accordance with the look-up table to thereby generate an adjusted inkjet control signal for the printhead carriage to perform an automatic calibration.

2. The system as claimed in claim 1, wherein the test pattern is formed with multiple vertical lines.

3. The system as claimed in claim 2, wherein the processor analyzes an image alignment level and shift error of the multiple vertical lines to thereby generate the look-up table.

4. The system as claimed in claim 1, wherein the test pattern is formed with multiple color blocks.

5. The system as claimed in claim 4, wherein the processor analyzes an image hug shift of the multiple color blocks to thereby generate the look-up table.

6. The system as claimed in claim 1, wherein the image extractor is an optical sensor.

7. The system as claimed in claim 1, wherein the recording medium is an opaque recording medium or a transparent recording medium.

8. An inkjet printing method for automatic calibration relating to non-uniform speed of a printhead carriage, comprising the steps of:

(A) receiving an automatic calibration request;

(B) printing at least one test pattern on a recording medium at a special print mode according to the automatic calibration request;

(C) capturing an image of the test pattern from the recording medium, and analyzing the image to accordingly generate a look-up table; and (D) adjusting a clock of an inkjet control signal for the printhead carriage in accordance with the look-up table to thereby output an adjusted inkjet control signal to the printhead carriage for performing the automatic calibration.

9. The method as claimed in claim 8, wherein the test pattern in is formed with multiple vertical lines.

10. The method as claimed in claim 9, wherein step (C) analyzes an image alignment level and shift error of the multiple vertical lines to thereby generate the look-up table.

11. The method as claimed in claim 8, wherein the test pattern in is formed with multiple color blocks.

12. The method as claimed in claim 11, wherein step (C) analyzes an image hug shift of the multiple color blocks to thereby generate the look-up table.

13. The method as claimed in claim 8, wherein the recording medium is an opaque or transparent recording medium.

14. An inkjet printing system capable of automatically calibrating non-uniform speed of a printhead carriage, including:

a test pattern generator, which generates at least one test pattern;

a printing device, which is connected to the test pattern generator in order to print the at least one test pattern on a recording medium;

an image extractor, which captures an image of the test pattern from the recording medium;

a processor, which is connected to the image extractor in order to read and analyze the image of the test pattern to accordingly generate a look-up table;

a printhead carriage control signal generator, which receives an encoder signal with respect to a printhead travel and generates an inkjet control signal for the printhead carriage in accordance with the encoder signal; and a look-up table device, which is connected between the processor and the printhead carriage control signal generator in order to receive the look-up table generated and accordingly adjusts a clock of the inkjet control signal to thereby generate an adjusted encoder signal.

15. The system as claimed in claim 14, wherein the test pattern is formed with multiple vertical lines.

16. The system as claimed in claim 15, wherein the processor analyzes an image alignment level and shift error of the multiple vertical lines to thereby generate the look-up table.

17. The system as claimed in claim 14, wherein the test pattern is formed with multiple color blocks.

18. The system as claimed in claim 17, wherein the processor analyzes an image hug shift of the multiple color blocks to thereby generate the look-up table.

19. The system as claimed in claim 14, wherein the image extractor is an optical sensor.

20. The system as claimed in claim 14, wherein the recording medium is an opaque or transparent recording medium.

* * * * *